US005567468A

United States Patent [19]

Lucas

[11] Patent Number: 5,567,468

[45] Date of Patent: Oct. 22, 1996

[54] METHOD AND APPARATUS FOR APPLYING POWDER COATINGS TO SURFACES

[75] Inventor: John M. Lucas, Cadyville, N.Y.

[73] Assignee: Schonbek Worldwide Lighting Inc., Plattsburgh, N.Y.

[21] Appl. No.: 322,008

[22] Filed: Oct. 11, 1994

[51] Int. Cl.[6] ..... B05D 1/22; B05D 1/04

[52] U.S. Cl. ..... 427/9; 427/460; 427/475; 427/348

[58] Field of Search ..... 427/460, 475, 427/348, 377, 378, 9, 10; 118/62, 63, 679

[56] References Cited

U.S. PATENT DOCUMENTS

| | | | |
|---|---|---|---|
| 3,928,655 | 12/1975 | Iwasa et al. | 427/21 |
| 4,427,712 | 1/1984 | Pan | 427/13 |
| 5,073,579 | 12/1991 | Macholdt et al. | 524/255 |
| 5,238,503 | 8/1993 | Phenix et al. | 134/37 |

OTHER PUBLICATIONS

Operations and Maintenance Manual, "Chargemaster® CH25 DC Power Supply", Aug. 1993, Publication 5100592 Rev 8, pp. 1–9. Product Specification Sheet, Airstatic–TS® I.

Product Specification Sheet, "Model HRS–1 Feed Hopper", Manual No. 32–16, Issued Sep. 1989, p. 1.

Product Specification Sheet, "100 Plus® Powder Pump", Manual No. 32–8, Issued Oct. 1989, p. 1.

Product Specification Sheet, "100 Plus™ Power Unit", PS–192, Issued Mar. 1989.

Product Specification Sheet, "Simco Aerostat AS30 Extended Range Static Eliminator".

Product Specification Sheet, "Versa–Spray® IPS Manual Powder Spray Gun", Manual No. 31–17, Issued Sep. 1992, p. 25.

*Primary Examiner*—Shrive Beck
*Assistant Examiner*—Fred J. Parker
*Attorney, Agent, or Firm*—Wolf, Greenfield & Sacks, P.C.

[57] ABSTRACT

An apparatus and method for powder coating the surfaces of objects provides a spray source of charged powder coat particles that engage the surface of the object. The thickness of the layer of particles can be regulated by measuring the resulting electrostatic surface potential generated by the particles. The layer of particles is treated by applying a balanced air flow positively and negatively-charged air ions that neutralize and transport surface particles from the object. The resulting surface has an electrostatic surface potential that is substantially equal thereon. This equal electrostatic surface potential translates into an even thickness coating along the object's surface. The treated surface is then cured by conventional heating and cooling processes to form a finished powder coat finish.

12 Claims, 6 Drawing Sheets

METHOD AND APPARATUS FOR APPLYING POWDER COATINGS TO SURFACES

FIELD OF THE INVENTION

The present invention relates generally to an improved method and apparatus for applying powder coating materials to surfaces of objects.

BACKGROUND OF THE INVENTION

The use of powder coating processes and materials for sealing and coloring of finished surfaces has become increasingly popular in recent years. Powder coating offers several advantages over conventional painting and dipping techniques in which a solvent-borne paint, lacquer, epoxy or other coating is applied to a surface. Unlike these solvent-based coatings, powder coating is a dry process in which no volatile solvent is utilized. Thus, no potentially harmful solvents are released into the environment or work place by powder coating. Additionally, improved control over the application of coating materials is possible in powder coating, since the coating materials are attracted to the object being coated. The nature of this attraction is explained in detail below. Finally, solvent-based coating systems waste substantial quantities of material due to overspray and adhesion of coatings to paint cans, spraying equipment and other vessels. Conversely, powder coating materials are almost entirely transferred from storage vessel to the object. Furthermore, oversprayed materials in powder coating can, potentially, be retrieved for reuse with proper handling.

Powder coating is an electrostatic process that generally entails the charging of particulate coating materials. These materials typically comprise thermoset plastic compounds that fuse together upon application of heat. The electrically charged particles of material are transferred from the end of a gun to the object to be coated. The object is typically a metal object that is grounded so that it is neutrally charged. The charged particles adhere to the surface of the object in a relatively even layer that is between 1 to approximately 4 or 5 thousandths of an inch (mils) in thickness. Once coated, the loose particles on the surface of the object must be cured to permanently adhere to the surface of the object. The object is transferred to an oven, where it is baked. The baking process causes the particles to fuse to each other and to the underlying surface. The resulting coating is exceptionally strong and resilient and resists most forms of environmental and chemical corrosion.

Powder coating can produce a variety of surface finishes by this process, including shiny, dull, metallic or reflective surfaces. Thus, powder coating is a highly versatile process that can be applied to a myriad of diverse products ranging from aerospace components to chandelier parts.

Two basic methods, and their corresponding devices, are currently utilized for applying powder coating materials. The first process, known as the "Corona" process, which is detailed in FIG. 1 (described below), involves the use of an electron gun tip that generates a corona of electrons that negatively charge the powder coat particles by attaching electrons to surrounding air molecules. The negatively-charged particles are directed to the surface of the object and adhere in layers to the object. The particles are attracted to the metallic surface and tend to build up on layers upon the surface over substantially the entire surface area of the object. As the particles build, the distance from the metallic surface to the particles becomes greater causing the attractive forces between the upper layer particles and the metallic object surface to decrease. When the attractive forces are outweighed by the interparticle repulsive forces, further build-up is typically prevented. At this point, the surface will not accept further particles of powder particles and any additional particles tend to fall loosely from the surface.

An alternate approach to powder coating entails the use of a tubular gun having an electric field along its inner surface that strips electrons from the particles. As the particles move down the gun, they become positively-charged by a process known as triboelectric charging. The exiting particles, thus, carry a positive charge, as detailed in FIG. 3 (described further below). The positively-charged particles adhere to the surface of the object in a manner similar to the negatively-charged particles of the corona process described above. Again, once a sufficient number of positively-charged powder coated particles are layered upon the object's surface, the forces of attraction become outweighed by the interparticle repulsive forces and, thus, further particles of powder coat fall loosely from the surface.

FIG. 1 details a schematic flow diagram of a powder coating apparatus and process according to this invention. The process illustrated employs a corona process powder coat gun 30 that receives high voltage electricity via a cable 32, interconnected with a voltage source and controller 34.

The gun 30 is further detailed in FIG. 2. It generates a corona 33 of electrons through which a spray 35 of particles passes. The corona 33 is generated between concentric electrodes 37 and 39. Voltage is provided by a cable 41 and pressurized powder coating particles are provided at an inlet 43. The flow of particles through the corona 33 is adjustable using the rotatable tip 45.

The controller 34 and gun 30, according to this embodiment, can comprise a Nordson Corporation 100 Plus® Power Unit and a corresponding Versa-Spray™ Cable-Feed Manual Spray Gun. The Nordson 100 Plus® Power Unit includes a voltage multiplier that is adjustable between 30 and 100 KVDC (30,000–100,000 volts) to generate a corona that electrostatically charges the powder particles. The control at 34 includes a power switch 36 and a voltage control 38 that regulates voltage in the cable 32 performing the corona at the tip 40 of the gun 30. A display 42 indicates the voltage.

The controller 34 also includes an inlet 44 for receiving compressed air from an air line 46 that is interconnected with a compressor 48. The controller 34 includes an atomizing air control knob 50 and a flow rate air control knob 52 with corresponding output meters 54 and 56 that control outgoing air flow to a pair of lines 58 and 60. The lines 58 and 60 are connected to a powder pump module 62 that receives powder particles via a short interconnection 62 from a powder particle feed hopper 66. Particles are drawn into the pump 62 by action of the flow rate air line 60 and are dispersed by the atomizing air line 58. Pressurized dispersed particles are delivered to the gun 30 via an output line 64. The particles exit the gun 30 by action of the trigger mechanism 67 (see FIG. 2) which opens a valve (not shown) in the gun allowing the pressurized particles to exit the gun tip 40. As noted above, a corona formed at the tip 40 charges the particles and also generates a field between the tip 40 and the object 68. As illustrated, a plurality of field lines 70 are defined between the tip 40 and the object 68 and the particles 72 travel generally along the field lines 70. Note also that the object 68 is interconnected with the ground 76 to neutralize any surface charge held by the object 68.

Subsequent to coating of the object 68 with a sufficient quantity of powder particles 72 to obtain an even surface coat, the object 68 is transferred to a heating station that can comprise an oven adapted to receive the particular object shape. A heating element 80 delivers heat to the surface of the object 68 to cause the particles to melt and fuse to each other performing an even and uniform surface across the object 68. Heating typically occurs for a period of time from 10 to 30 minutes at temperatures of approximately 350° to 400° F. Many powders specify exact temperatures and time durations for the curing process.

Subsequent to heating, the object is allowed to cool to room temperature, either within the oven or at a cooling location 82 remote from the over. The finished object can then be handled normally.

As discussed above, alternate approach to applying particles to an object 68 known as the triboelectric process is illustrated in FIG. 3. This process utilizes a feed pump 162 and compressor 148 having air outlet line 146, flow rate and atomization air pressure lines 160 and 158, respectively, similar to those used in the corona process of FIG. 1. Similarly, a controller 134 is utilized to control the powder atomization and flow rate via controls 150 and 152, respectively. Values for atomization and flow rate pressure are read on corresponding meters 154 and 156, respectively. The pressurized particles are transferred down the outlet feed line 164 to the triboelectric gun 130. The gun 130 is, likewise, fed high voltage electricity from the controller 134 via a cable 132.

The gun 130 comprises an elongated metallic tube 190 that generates a substantial electric field within its inner diameter 192. The gun 130 is operated to induce particle flow by the trigger 167. As particles move down the tube 190 under pressure, they strike each other and the walls of the inner diameter 192 of the tube 190 becoming "triboelectrically-charged". In other words, the particles are stripped of electrons through action of the field. Thus, the particles exit the tip 140 of the tube 190 in a positively-charged state. The charged particles are attracted to the object 68 in a manner similarly to the negatively-charged corona particles of FIG. 1. The object 68 is connected to ground 176 as in the corona process of FIG. 1.

The triboelectric process differs from the corona process, generally, in that no electric fields are generated between the tip 140 and the object 68. Thus, the particles tend to strike the object in a more-dispersed manner. However, the resulting coating of the object is of somewhat similar quality and differs from the corona process primarily in that the surface particles carry a positive charge rather than a negative charge. Curing of the triboelectrically-charged particles occurs in a substantially similar manner to curing in the corona process. A heating element 180 provides heat in a range of approximately 350°–450° F. for a time period of 10 to 30 minutes to the object 68, which is then generally allowed to cool at a cooling location 82, either within, or remote form the heating area.

Both the corona and triboelectric process are typically carried out within an appropriate spray booth, having adequate ventilation and protection from loose flying particles.

A current disadvantage of the application of powder coatings using both the corona and triboelectric processes is that surface thicknesses remain somewhat variable. In fact, a surface on a typical object can vary in thickness by up to two to three thousandths of an inch between different areas on the surface. Such an uneven surface coating can be undesirable, particularly where reflective surfaces are used or where a precision appearance is desirable.

It is, therefore, an object of the present invention to provide an improved method and apparatus for applying powder coatings to surfaces of objects with better control of the thickness of the coating layer. This invention should also provide a method and apparatus that generates a more even coating layer thickness over the object with a minimum of surface imperfections in the coating layer.

This method and apparatus should be implemented with a minimum of additional equipment and should be adapted for use by ordinarily skilled technicians in the field.

SUMMARY OF THE INVENTION

This invention relates to an improved apparatus and method for powder coating the surfaces of objects that overcomes certain disadvantages of the prior art. Unlike the prior art, which, heretofore, has relied upon pressure, voltage and spray duration to control the quality and thickness of surface coatings, this invention utilizes the electrostatic potential generated by the particles on the surface to determine and regulate the thickness of the coating layer. It is recognized that the electrostatic potential of the surface varies with the thickness of the particle layer. The potential increases as the thickness increases and, likewise, decreases as the thickness decreases. By maintaining an electrostatic surface potential of approximately 300 volts, a high quality surface finish can be obtained. The desired thickness may vary for different types of powder coat material, so the exact thickness and corresponding surface potential should be determined for each material on a subjective experimental basis.

According to one embodiment of this invention, the electrostatic surface potential of the powder coating layer is measured, subsequent to application of the particulate coating material, by using a conventional static meter passed over some, or substantially all, of the surface. A further improvement to the powder coat process, according to this invention, entails the generation of a relatively even surface potential by applying a neutralizing gas flow (typically an air flow) over the coated surface. Such neutralizing flow can be provided by an anti-static ionized air flow unit that generates a relatively-balanced flow of positively-charged and negatively-charged ionized air molecules. The air flow is ionized so that it neutralizes only less-attracted particles on the upper surface of the layer. More-attracted particles remain unneutralized. For the equipment utilized according to this embodiment, a 1000 volt ionization setting produces neutralization of all particles above a surface potential of approximately 300 volts. By applying an appropriate volume of air flow, the ionizing air flow can also act as a transport vehicle to move the now neutralized particles off the surface. The resulting surface has a constant electrostatic surface potential and, hence, a constant thickness thereover. The surface can be subsequently cured, by appropriate heat or other curing mechanisms to form a finished surface of fused particles.

The above-described process is applicable generally to corona-type powder coat devices. However, this technique is also applicable to triboelectric-type equipment. It can be necessary, however, to reverse the polarity of the positively-charged powder coat particles on the surface by applying a stream of negatively-charged stream of gas prior to application of the neutralizing stream of balanced positively-charged and negatively-charged ionized air.

BRIEF DESCRIPTION OF THE DRAWINGS

The foregoing and other objects and advantages of the invention will become more clear with reference to the following detailed description of the preferred embodiments as illustrated by the drawings in which.

DETAILED DESCRIPTION OF THE PREFERRED EMBODIMENT

Figure 4:
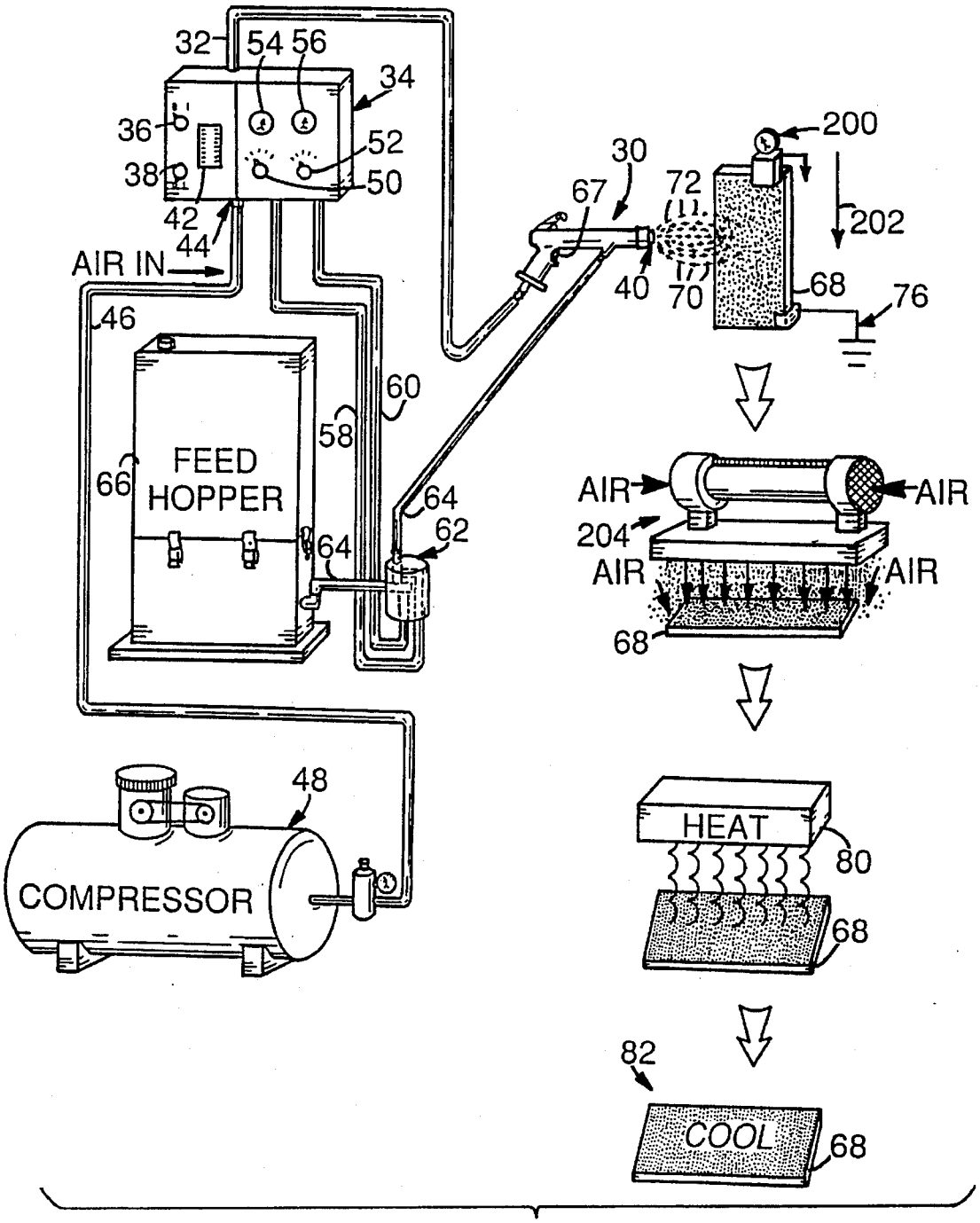
FIG. 4 is a schematic perspective view of an improved corona powder coating process according to this invention.

FIG. 4 illustrates an improved process and apparatus for providing powder coating that overcomes certain disadvantages of the prior art corona process. The process illustrated relates to corona-type equipment, however, as described below, the techniques herein are generally applicable to a triboelectric-type process.

Figure 1:
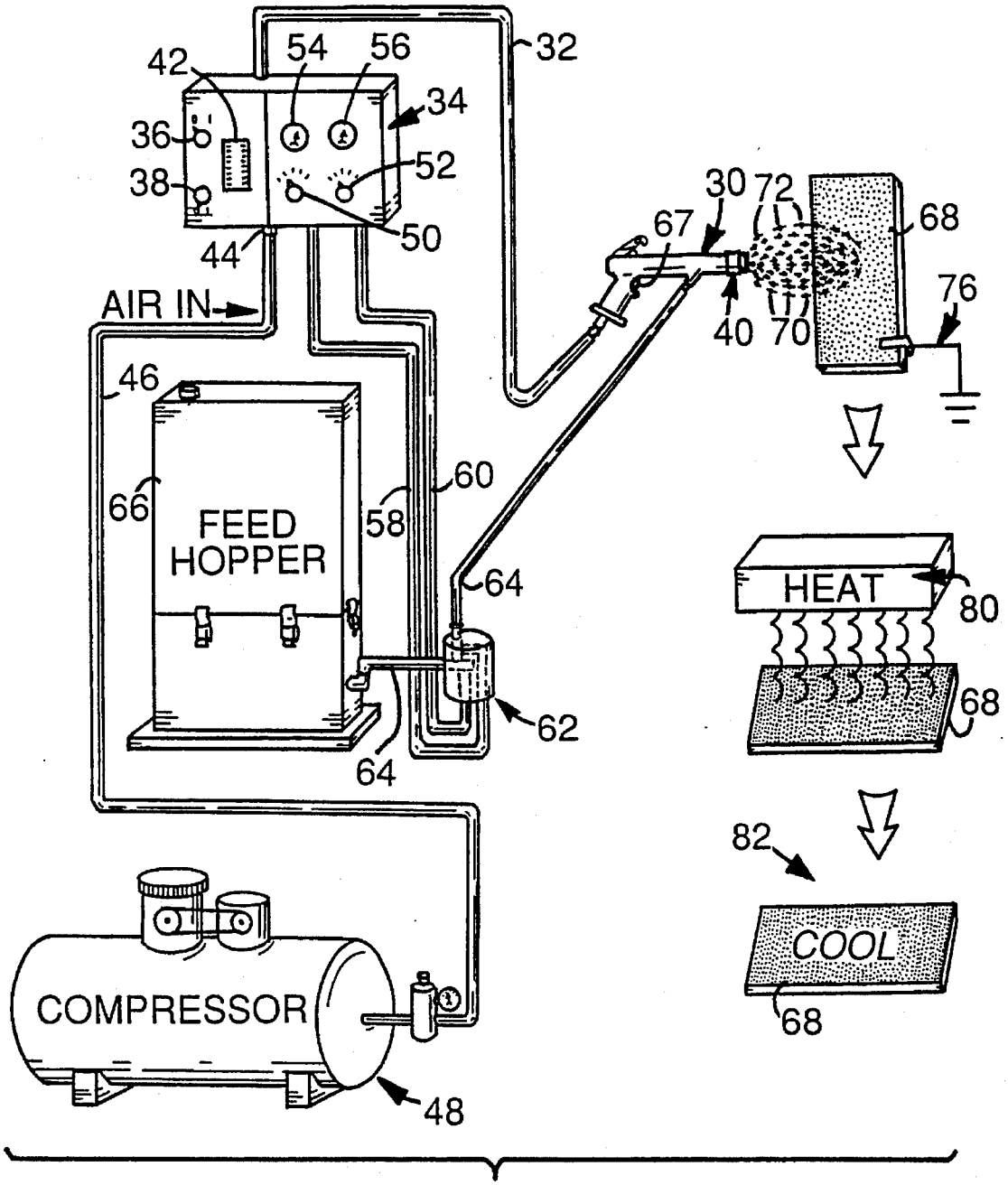
Fig. 1 (PRIOR ART)
FIG. 1 is a somewhat schematic perspective view of a corona powder coating apparatus and process according to the prior art.
Figure 2:
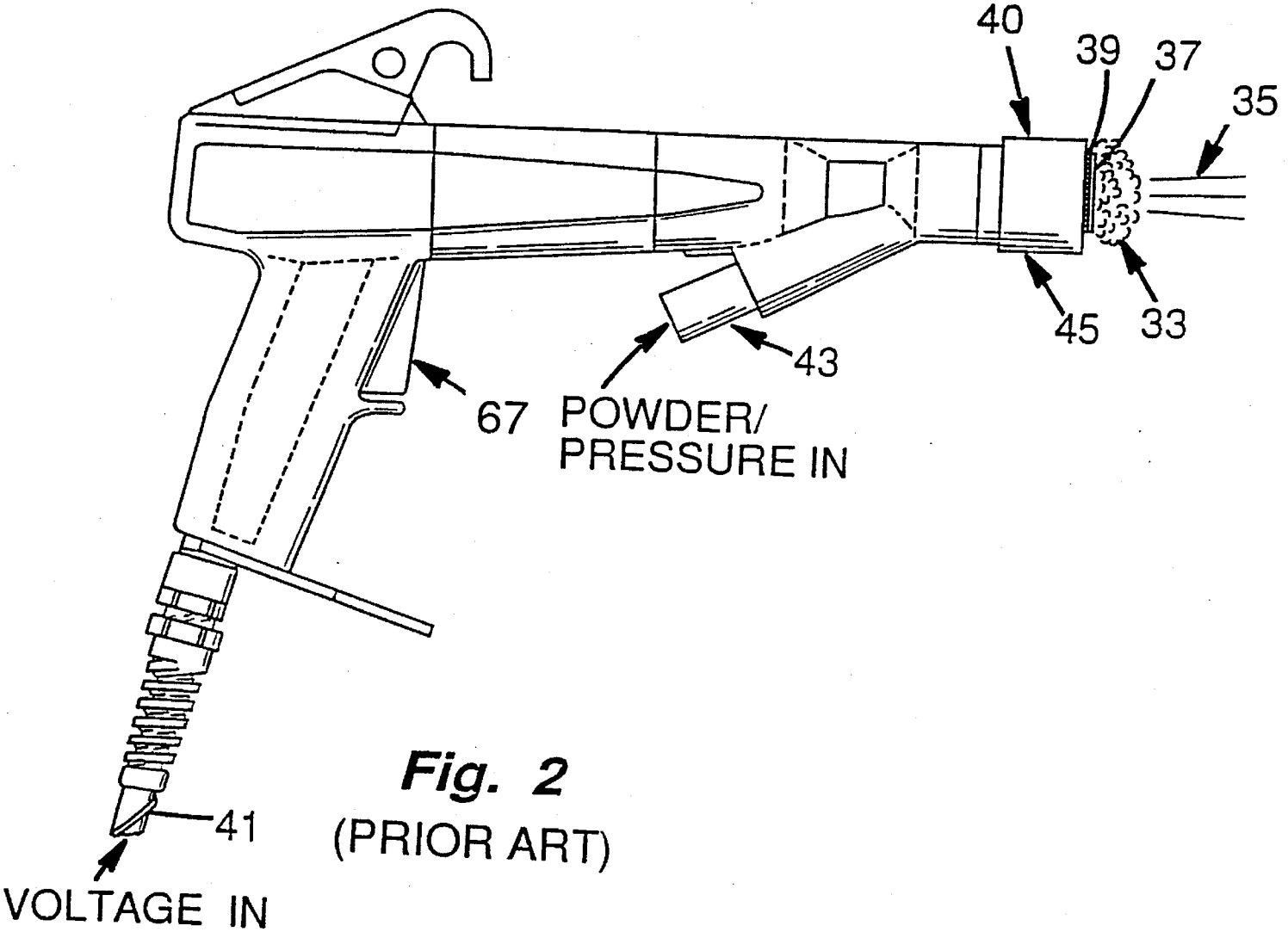
Fig. 2 (PRIOR ART)
FIG. 2 is a side view of a corona powder coat gun according to the prior art process of FIG. 1.

The controller 34, feed hopper 66, powder pump 62, compressor 48, appropriate pressure lines 46, 58, 60, 64, and electric line 32 are conventional and substantially the same as those described in prior art. Where such elements are the same, like reference numbers to those occurring in FIG. 1 have been utilized. Similarly, the gun 30 having a corona-generating tip 40 and a trigger 67 is also similar. As noted above, these elements are available from the Nordson Company. The feed hopper 56 can comprise a Nordson® HRS-1 Feed Hopper. The powder pump 62 can comprise a 100 Plus® Powder Pump. The controller 34 can comprise a 100 Plus® Power Unit and the gun 30 can comprise a Versa-Spray™ Cable-Feed Manual Spray Gun. A variety of tip configurations are available for this gun and enable the operator to generate a plurality of spray patterns for coating different sized and shaped objects.

According to this embodiment, powder particles 72 are provided to the object 68 by a hand spraying technique. Automatic sprayers are also expressly contemplated. The gun tip 40 is maintained at a distance from approximately 10 inches to 2 and ½ feet from the object 68. However, a variety of distances are contemplated and a distance that provides the best spray coverage, without surface imperfections should be used.

According to this embodiment, utilizing the above-described Nordson equipment, it is contemplated that the following parameters should be utilized in setting the controller 34:

| Flow Rate | Atomizing Pressure | Fluidizing Pressure | Voltage |
|---|---|---|---|
| 3 PSI | 9 PSI | 4 PSI | 100 KV |

These values have been found to be optimum when using a powder coating particulate material available from Powder Technologies Incorporated having stock number PTUS99CC02. The color "CLEAR" has been utilized in the experiments performed.

The object 68 should receive proper surface preparation, including complete cleansing and degreasing to remove all foreign matter from the surface. The powder coating process according to this embodiment has been tested on mild steel strips having a flat service and length of between 1½ and 2 feet, a width of approximately 3 inches and a thickness of approximately 1/16 inch. The surface has been provided with a mirror polish finish. However, it is contemplated that an object of any shape, size or surface finish can be effectively powder coated according to this embodiment.

Conventional powder coating techniques typically entail the control of pressure at the pump 62 and gun 30, as well as corona voltage, coating distance and duration, in order to provide an optimum powder coat layer. Unlike these conventional techniques, applicant contemplates better control of the thickness of the coating material on the object 68 by recognizing that the charged particles 72 generate a surface potential as they lay upon the surface of the object 68. It has been recognized that the surface potential generated by the particles is lower as the thickness of the particle layer on the objects 68 decreases. Conversely, the surface potential increases, to an approximate maximum value, as the thickness of the layer increases. As noted above, if the thickness increases beyond a predetermined point, particles no longer adhere to all portions of the object surface and a very uneven-thickness surface results.

The surface potential generated by the particles results, in part, from the build-up of charged particles on the object resulting in isolation of more-distant particles from the object surface. More potential is maintained within the particles as they are more isolated from the object surface. Thus, they tend to be less attracted to the surface and more-charged, as their distance from the surface increases.

Accordingly, the powder coating process according to this embodiment incorporates the use a conventional static meter to 200 that is moved (arrow 202) across the surface of the object 68 to determine the surface potential of the coating. The static meter utilized can comprise a ACL model 300 B static meter having low and high measurement ranges of 0–500 volts and 0–30 KV, respectively.

Figure 5:
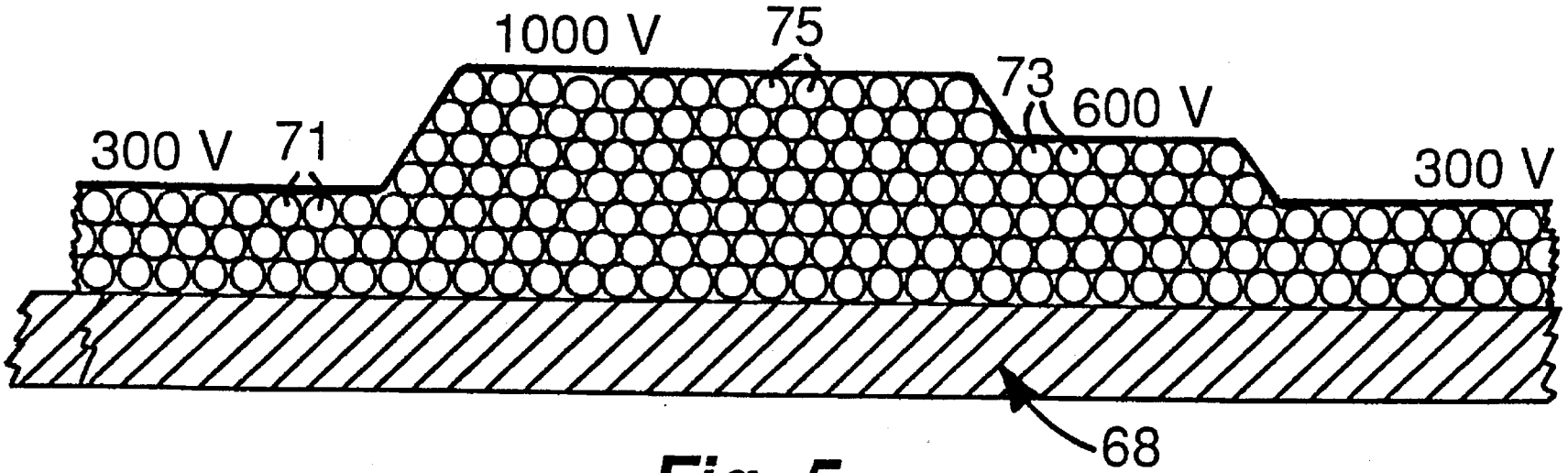
FIG. 5 is a schematic side view of a typical layer of powder coating material on an object following initial application of powder coating to the surface.

In performing a static test on the object 68, following a coating by the gun 30 according to a conventional process, a variation in potential across the object 68, of between 300 volts and 1,000 volts is typically measured by the meter 200. This variation is exemplified by the diagram in FIG. 5. The least-thickness layer of particles 71 has electrostatic potential of approximately 300 volts. An intermediate-thickness layer of particles 73 has a potential of approximately 600 volts. These particles 73 are less-attracted to the object 68 than the lower particles 71. The thickest layer particles 75, which are most remote from the object 68, have a very high potential of 1000 volts and are the least-attracted to the object. When correlating this potential to the coating layer thickness as measured using a QuaNix 1500 Coating Thickness Gauge, it was determined that the surface potential increases by approximately 100 volts for each 0.4 thousandth of an inch in coating thickness (0.4 mils).

Using a subjective quality analysis, viewing surfaces having potentials of 200 volts, 300 volts, 600 volts, and 1,000 volts, it has been determined that the most pleasing surface, having the lowest incidence of "orange peel" occurred when the surface potential is approximately 300 volts for the specific powder employed. Such a surface potential corresponds generally to a thickness of approximately 1.5 thousandths of an inch (1.5 mils).

According to this embodiment, it is contemplated that control of coating thickness can be maintained by monitoring the electrostatic potential generated by the surface as it is formed on the object 68. When a given potential is attained, the coating process is stopped. Such monitoring can be accomplished by means of a static meter 200, that is either located stationarily or that is moved across the object to continuously monitor potential. However, other forms of static monitoring can be used and are expressly contemplated by the invention.

Despite monitoring of static build-up on the coating layer, uneven thickness coating can still occur. Thus, this invention contemplates an additional (or alternative step since initial monitoring can be omitted in view of the following improvement) step of ensuring that the static potential across the surface of the object 68 is constant. Such a constant static potential is obtained while simultaneously maintaining a predetermined constant coating thickness across the entire object surface.

According to this embodiment, the object 68, subsequent to coating, is located, adjacent an ionized air source 204. The ionized air source can comprise a Simco Aerostar™ AS30 Extended Range Static Eliminator, manufactured by the Simco Company, Inc. The AS30 comprises a 100–300 cubic foot per minute (CFM) air source interconnected with an ionization chamber that enables generation of a balance flow of positively and negatively-charged ionized air. The AS30 includes brackets enabling it to be wall or ceiling-mounted to allow objects to pass thereunder. Using the unit's voltage adjustment control, the voltage should be set to approximately 1,000 volts. By locating the unit approximately 2 inches from the object, the air flow, at an approximately-maximum value, is sufficient to transports lightly held particles away from the surface of the object 68.

It has been found that a setting of 1,000 volts and a spacing of approximately 2 inches from the object causes a neutralization of loosely held particles so that the air flow can transport the particles from the layer. The resulting measured layer, following treatment with the ionized air flow, has an approximately uniform static potential over the entire surface of the object 68. This potential measures approximately 300 volts. As noted above, a 300 volt potential translates to a thickness of approximately 1.5–1.6 thousandths of an inch.

The neutralization of upper layer particles results, in part, from the fact that they are more remotely-positioned from the object surface and, thus, are less-attracted to the object surface. Hence, they are more susceptible to the neutralizing effects of the ionized air flow at the given potential. By raising the potential of the ionized air, a deeper neutralizing effect can be attained that would tend to further reduce the thickness (and residual static charge) of the object surface. Conversely, a lower potential ionized air flow would tend to have less of a neutralizing effect and detach only more remote and high-potential particles. The AS30 is not particularly adapted for transport of particles from a surface. Rather, it is designed primarily for static prevention.

It is contemplated that a higher air flow unit, generating a larger charge potential can be utilized, thus, allowing the unit to be located more-remotely from the object 68. Given such a unit, the optimum setting for potential would be determined by testing the neutralizing effect of an air flow at a number of selected potential levels. When the desired surface static charge on the object is obtained, the air flow unit's setting is noted and that setting is utilized for future production runs. It is desirable that the air flow generated by the air flow unit be sufficient to transport loosely-attached or neutralized (unattracted) particles from the surface of the object, but not large enough to detach particles that are still-unneutralized and attracted to the object surface. An excessive amount of air flow can undesirably detach all particles from the surface, regardless of their attractive state. Thus, air flow rate should be regulated carefully.

After applying the ionized air flow using the air flow source 204, the object surface can again be checked using a static meter to ensure that a uniform electrostatic surface potential (hence, thickness) exists over the entire object 68 surface. The object 68 is then exposed to a heating element 80 and cured in a conventional manner, similar to that described in FIG. 1. The finished object is then cooled at a cooling location 82. The resulting surface is optimized and uniform in coating thickness, and displays superior surface finished characteristics.

Figure 3:
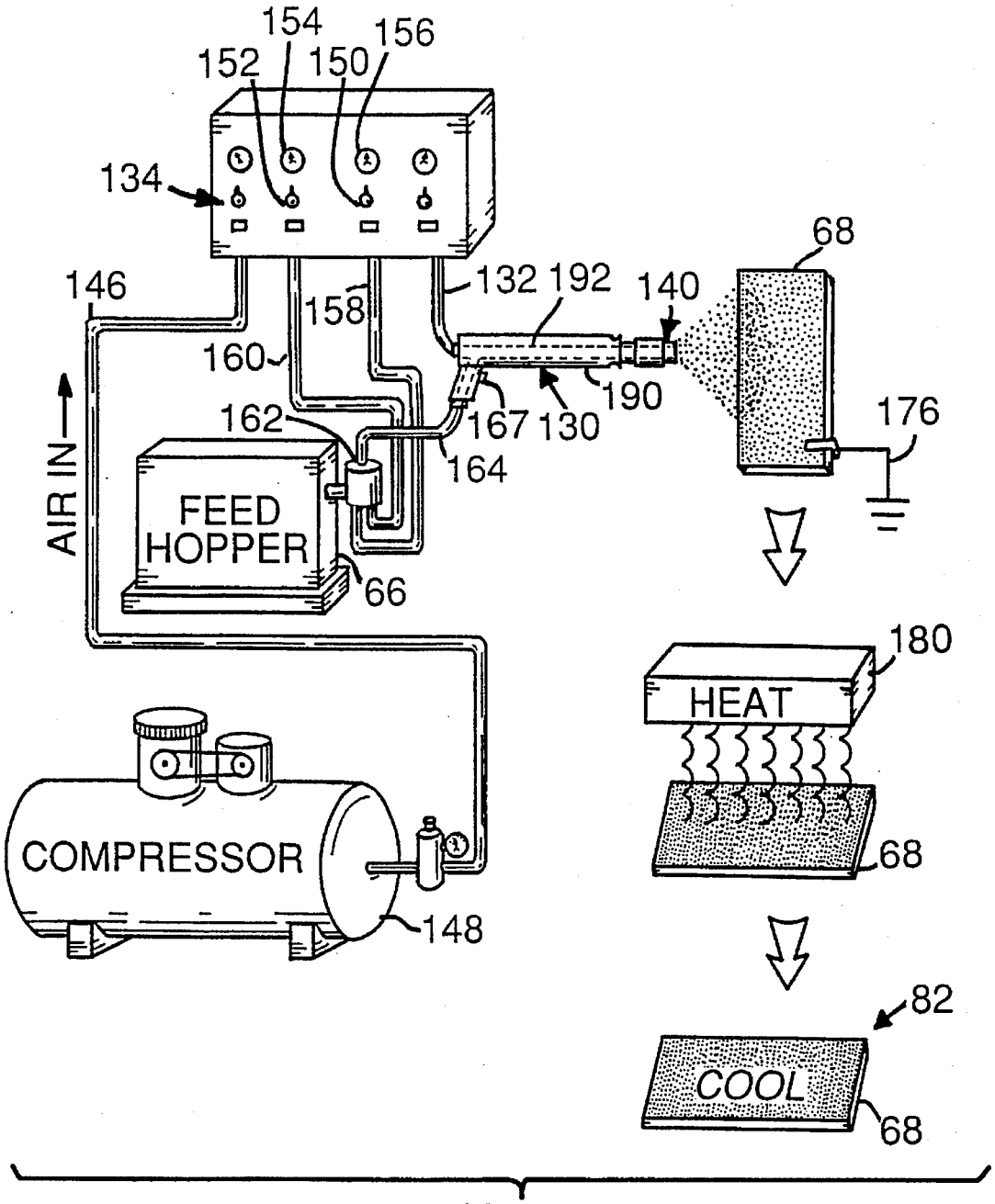
Fig. 3 (PRIOR ART)
FIG. 3 is a schematic perspective view of a triboelectric powder coating apparatus and process according to the prior art.

As noted above, the triboelectric process of powder coating, as described generally in FIG. 3, can be preferable in certain applications. For example, it has been recognized that corona-charged particles of powder coating material tend to repel each other when applied into an inside corner of an object. Such a corner forms a Faraday Cage in which repellant forces of particles form a dam that prevents full entry of particles into the inside corner. This effect is most pronounced for acute-angled corners in which particles on opposing corner walls are placed into relatively close contact near the corner edge. Triboelectrically-charged particles do not exhibit such repulsive characteristics and tend to fully fill the corner of a Faraday Cage. Similarly, triboelectrically-charged particles contact the object in an even spray pattern, unlike corona particles that tend to follow field lines between the gun tip and the object surface.

Figure 6:
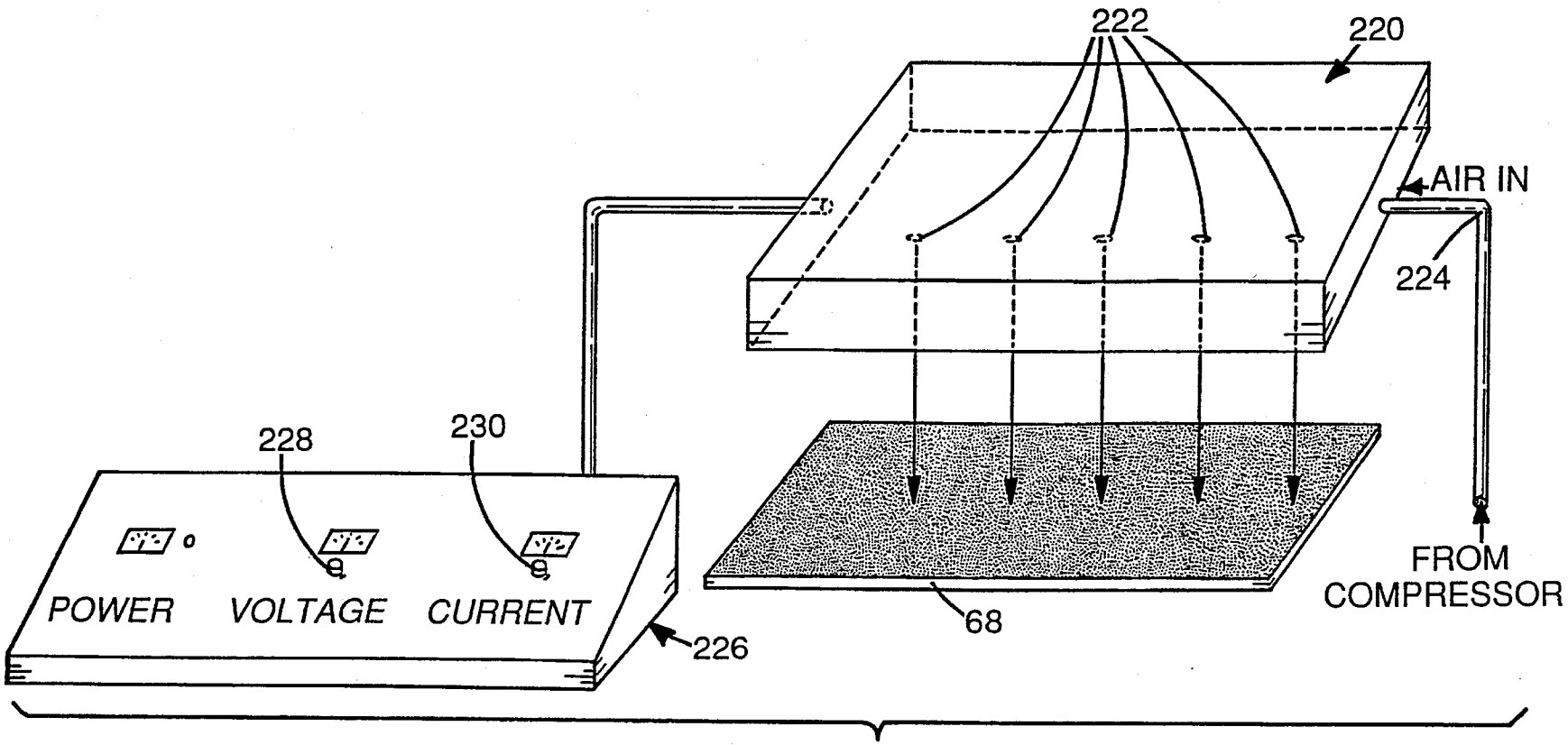
FIG. 6 is a schematic perspective view of the treatment of triboelectrically-charged powder coat particles according to an alternate embodiment of this invention.

FIG. 6 illustrates a process for treating triboelectrically-charged powder coat material according to an alternate embodiment of this invention. The powder coat material has been applied in a manner set forth in FIG. 3. According to this embodiment, an Aerostatic-TS®I unit manufactured by Intec-APS, a division of Advanced Powder Coatings, Inc., can be utilized.

The powder coating, according to the triboelectric process, can also be controlled by measuring the surface potential charge on the object 68 in a manner similar to that described for the embodiment of FIG. 4. It has been recognized that a uniform surface potential indicates a substantially uniform surface thickness.

As illustrated in FIG. 6, a metallic pressure box 220 having evenly-spaced, approximately ¼ inch diameter, holes 222, is utilized to apply an air flow to the coated object 68. The holes 222 are spaced approximately 3 inches apart (on center). The air flow is generated by a compressor or other air source (not shown). An air pressure of approximately 25 PSI can be provided to the air inlet line 224. However, it is contemplated that other pressures can be suitable and can be utilized depending upon the structure of the air delivery system and the distance of the air delivery system from the object 68.

The metallic box 220 is interconnected with a negative ion generator. In this embodiment, the ion generator comprises a Charge Master 25 High Voltage DC Power Supply 226 available from the Simco Company. The power supply 226 has variable voltage and current controls 228 and 230, respectively. Voltage is variable from 0–25,000 VDC and current is variable from 0–2 mA DC. By applying maximum voltage to the box 220, a negatively-charged stream of air can be generated. The negatively-charged stream of air, spaced approximately one foot from the object 68, has been found to reverse the polarity of the surface potential from a positive to a negative value. The absolute value of the potential has been found to be substantially similar when polarity is reversed. In other words, if a positive 300–1000 volt positive surface potential existed across various regions of the object, this potential would be altered to a substantially similar 300–1000 volt negative surface potential across the same regions. By applying further air flow or, alternatively, by then applying a balanced positively and negatively-ionized air flow using, for example, the air source 204 detailed in FIG. 4, one can transport unwanted particles from the surface, generating a desired surface thickness that is uniform across the entire surface of the object 68.

A surface treated according to the process of FIG. 6 can be subsequently heat-cured and cooled in a conventional manner as described herein. It is contemplated that the exact voltage and potential of the negative field used according to FIG. 6 can be varied to obtain optimum results, similarly air flow across the surface can be varied. It should be noted that ionized air having an extreme potential can cause back-ionization of particles on the object surface. Such back-ionization can cause uneven craters and cavities.

The foregoing has been a detailed description of preferred embodiments. Various modifications and additions can be made without departing from the spirit and scope of this invention. For example, the ionized gas or air flow delivery device, as described herein, can be configured to provide optimum air flow to various sized and shaped objects. Conveying systems can be provided to automate the powder coating and the ionized air flow-application process. Similarly, the testing of the static potential on the object surface can be performed automatically. Additionally, the processes and equipment described herein can be applied to a variety of shapes and sizes of objects with favorable results. Powders that cure or fuse together by mechanisms other than heat are also contemplated. While air is a preferred particle transport and treatment vehicle according to a preferred embodiment, other gasses are also contemplated. These gases should be capable of ionization when used in place of ionized air. Accordingly, this description is meant to be taken only by way of example and not to otherwise limit the scope of the invention.

What is claimed is:

1. A method for powder coating a surface of an object comprising the steps of:

applying a stream of electrostatic charged powder coat particles to the surface of the object;

providing an ionized gas flow of opposite charge relative to the charge on the powder coat particles to the surface of the object so that the gas flow neutralizes and transports at least some of the particles from the surface, leaving a substantially-uniform layer of powder coat particles; and curing the powder coat particles to form a finished powder coat surface.

2. A method as set forth in claim 1 wherein the step of applying charged powder coat particles includes generating a corona of electrons through which the powder coat particles pass to gain a charge.

3. The method as set forth in claim 1 wherein the step of providing an ionized gas flow includes generating a substantially-balanced flow of positively-charged gas and negatively-charged gas.

4. The method as set forth in claim 3 providing a volume of gas flow that is sufficient to transport, away from the surface, neutralized particles, but is insufficient to transport particles that retain electrostatic attraction to the surface.

5. The method as set forth in claim 1 further comprising determining a thickness of the layer of powder coat particles on the surface by measuring an electrostatic potential of the surface.

6. The method as set forth in claim 3 further comprising regulating the thickness of the layer of powder coat particles applied to the surface based upon a plurality of measurements of the electrostatic potential of the surface based upon a reading of a static meter.

7. The method as set forth in claim 1 wherein the step of applying a stream of charged powder coat particles includes applying triboelectrically positive-charged powder coat particles to the surface.

8. The method as set forth in claim 7 further comprising applying a negatively-charged gas flow to the surface having the charged powder coat particles deposited thereon to change a polarity of the charge of the powder coat particles, prior to transporting away neutralized particles.

9. A method as set forth in claim 1 further comprising controlling a potential of the ionized gas flow to neutralize a portion of the particles on the surface.

10. A method for regulating a thickness of a coating layer on an object comprising the steps of:

applying a stream of electrostatic charged powder coat particles to a surface of the object;

measuring an electrostatic surface potential generated by the charged powder coat particles on the surface of the object; and adjusting the step of applying charged powder coat particles to maintain a specific electrostatic surface potential generated by the charged powder coat particles on the surface of the object.

11. A method as set forth in claim 10 wherein the step of measuring includes reading the electrostatic surface potential at a plurality of locations on the coating layer.

12. A method as set forth in claim 10 further comprising providing a substantially-balanced flow of positively-charged and negatively-charged ionized gas to the charged powder coat particles on the surface of the coating layer to neutralize a portion of the particles on the surface of the coating layer and transporting neutralized particles from the surface of the coating layer.

* * * * *